US009091242B2

(12) United States Patent
Björklund et al.

(10) Patent No.: US 9,091,242 B2
(45) Date of Patent: Jul. 28, 2015

(54) STARTING OF AN INTERNAL COMBUSTION ENGINE

(75) Inventors: Dan Björklund, Kaskinen (FI); Jukka Mäntylä, Laihia (FI)

(73) Assignee: Wärtsilä Finland Oy, Vaasa (FI)

( * ) Notice: Subject to any disclaimer, the term of this patent is extended or adjusted under 35 U.S.C. 154(b) by 267 days.

(21) Appl. No.: 13/818,930

(22) PCT Filed: Aug. 9, 2011

(86) PCT No.: PCT/FI2011/050699

§ 371 (c)(1),
(2), (4) Date: Apr. 10, 2013

(87) PCT Pub. No.: WO2012/035199

PCT Pub. Date: Mar. 22, 2012

(65) Prior Publication Data

US 2013/0186355 A1 Jul. 25, 2013

(30) Foreign Application Priority Data

Sep. 17, 2010 (FI) ..... 20105951

(51) Int. Cl.
*F02N 9/04* (2006.01)
*F02N 19/00* (2010.01)
*F02N 15/02* (2006.01)

(52) U.S. Cl.
CPC *F02N 19/00* (2013.01); *F02N 9/04* (2013.01); *F02N 15/022* (2013.01); *F02N 15/028* (2013.01); *F02N 2200/021* (2013.01)

(58) Field of Classification Search
CPC ..... F02N 19/00; F02N 15/022; F02N 9/04; F02N 2200/021; F02N 15/028
USPC ..... 60/625–631
See application file for complete search history.

(56) References Cited

U.S. PATENT DOCUMENTS

| | | | | |
|---|---|---|---|---|
| 5,458,098 | A | 10/1995 | Yagi et al. | |
| 6,216,669 | B1 * | 4/2001 | Aoki | 123/406.65 |
| 7,155,788 | B1 | 1/2007 | Chang | |
| 2005/0061371 | A1 * | 3/2005 | Kimbara et al. | 137/266 |

(Continued)

FOREIGN PATENT DOCUMENTS

| | | | |
|---|---|---|---|
| EP | 1 321 666 | A1 | 6/2003 |
| EP | 1 845 250 | A1 | 10/2007 |

(Continued)

*Primary Examiner* — Hoang Nguyen
(74) *Attorney, Agent, or Firm* — Muncy, Geissler, Olds & Lowe, P.C.

(57) ABSTRACT

A starting system for an internal combustion engine comprising a pressure medium source, means for connecting the pressure medium source to at least two of the cylinders of the engine, a starting valve in connection with each cylinder that is connected to the pressure medium source for controlling the admission of the pressure medium into the cylinder, a control unit for controlling the operation of the starting valves, and an absolute rotary encoder for determining the crank angle of the engine. The system further comprises coupling means arranged between the engine and the absolute rotary encoder for releasably coupling the encoder to the engine. The invention also concerns a method for starting an internal combustion engine and an internal combustion engine.

8 Claims, 2 Drawing Sheets

(56) References Cited

U.S. PATENT DOCUMENTS

| | | | | |
|---|---|---|---|---|
| 2007/0005222 | A1* | 1/2007 | Lepley et al. | 701/113 |
| 2007/0119403 | A1 | 5/2007 | Laubender | |
| 2009/0152070 | A1* | 6/2009 | Nakamura et al. | 192/219 |

FOREIGN PATENT DOCUMENTS

| | | | |
|---|---|---|---|
| GB | 1375679 | A | 11/1974 |
| JP | 58222974 | A | 12/1983 |
| NL | 8701151 | A | 12/1988 |

* cited by examiner

STARTING OF AN INTERNAL COMBUSTION ENGINE

TECHNICAL FIELD OF THE INVENTION

The present invention relates to a starting system for an internal combustion engine in accordance with the preamble of claim 1. The invention also concerns a method for starting an internal combustion engine and an internal combustion engine, as defined in the preambles of other independent claims.

BACKGROUND OF THE INVENTION

Large internal combustion engines that are used for instance in ships and power plants are usually started by using pressurized air that is injected sequentially into the cylinders of the engine for rotating the crankshaft. It is desirable to minimize the amount of starting air that is needed for starting an engine. Pressurized starting air needs to be stored in large air receivers that require a lot of space. The energy needed for pressurizing the starting air is usually taken from the engine itself, and it is therefore also desirable to minimize the energy consumption for this purpose.

To minimize the consumption of starting air, it is important to select the most suitable cylinder for the initial starting air injection. To be able to do this, the crank angle of the engine must be determined. Engines are often equipped with crank angle sensors that can be used for instance for determining correct fuel injection timing. These sensors are usually incremental encoders, which determine the crank angle on the basis of detection of a reference mark and angular changes of the crankshaft. This means that the crank angle cannot be determined when the engine is at rest. One method for determining the crank angle is to rotate the engine before start so that a reference mark passes the crank angle sensor and the absolute crank angle is thus known. Then the engine has to be rotated further into a starting position. A drawback of this method is that the method is time consuming and a lot of energy is needed. Due to vibrations, the method can also be inaccurate.

An alternative way is to use an absolute rotary encoder to determine the crank angle of the engine. With an absolute rotary encoder, the exact crank angle of the engine can be determined even when the engine is at rest. Patent application US 2007005222 A1 discloses an air start-up system for an internal combustion engine. The system comprises solenoid-controlled starting valves in connection with each cylinder of the engine for introducing starting air into the cylinders. An absolute rotary encoder is used to detect the angular position and rotational speed of the engine for determining the correct timing and duration of starting air injection.

A problem with absolute rotary encoders is that they are fragile and not intended for extended periods of rotation at high speed. Therefore, the lifetime of an absolute rotary encoder is often very limited.

SUMMARY OF THE INVENTION

The object of the present invention is to provide an improved starting system for an internal combustion engine, a method for starting an internal combustion engine, and an internal combustion engine. The system according to the present invention is characterized by the characterizing part of claim 1. The method and internal combustion engine according to the invention are characterized by the characterizing parts of other independent claims.

According to the present invention, the starting system for an internal combustion engine comprises a pressure medium source, means for connecting the pressure medium source to at least two of the cylinders of the engine, a starting valve in connection with each cylinder that is connected to the pressure medium source for controlling the admission of the pressure medium into the cylinder, a control unit for controlling the operation of the starting valves and an absolute rotary encoder for determining the crank angle of the engine. The system further comprises coupling means arranged between the engine and the absolute rotary encoder for releasably coupling the encoder to the engine.

The releasable coupling enables decoupling of the absolute rotary encoder from the engine when the engine is running. Since the absolute rotary encoder can be decoupled from the engine when it is not needed for starting, its lifetime can be significantly increased.

According to an embodiment of the present invention, the engine is provided with additional means for determining the rotation speed and crank angle of the engine. The means for determining the rotation speed and crank angle of the engine can be for instance a separate rotation speed sensor that measures the rotation speed from a flywheel and a phase sensor that determines the crank angle based on the angular position of a camshaft. These sensors can be used when the absolute rotary encoder is decoupled from the engine.

According to another embodiment of the invention, the coupling means comprise a clutch having a first clutch part rotating with the crankshaft of the engine and a second clutch part being engageable into a predetermined position with the first clutch part.

In the method for starting an internal combustion engine in accordance with the present invention

- the crank angle of the engine is determined by means of an absolute rotary encoder,
- based on the crank angle, a suitable cylinder for pressure medium injection is selected,
- pressure medium is introduced into the selected cylinder for rotating the crankshaft of the engine,
- the previous steps are repeated until the engine is running,
- the crank angle and rotation speed of the engine are determined by means of the absolute rotary encoder,
- the crank angle and rotation speed data of the absolute rotary encoder are compared to the data of additional means for determining the rotation speed and crank angle of the engine, and
- the previous two steps are repeated until the additional means for determining the rotation speed and crank angle of the engine are synchronized with the absolute rotary encoder.

After a predetermined rotation speed is reached and the additional means for determining the rotation speed and crank angle of the engine are synchronized with the absolute rotary encoder, the absolute rotary encoder is decoupled.

With the method according to the present invention, the starting air consumption can be minimized while maximizing the lifetime of the absolute rotary encoder.

According to an embodiment of the present invention, the absolute rotary encoder is coupled when the rotation speed of the engine drops below a predetermined value. The encoder is thus coupled to the engine when the engine is to be started next time. According to an embodiment of the invention, the value is set at zero and the encoder is thus coupled when the engine is stopped.

The internal combustion engine according to the present invention comprises a starting system defined above.

DETAILED DESCRIPTION OF THE INVENTION

Figure 1:
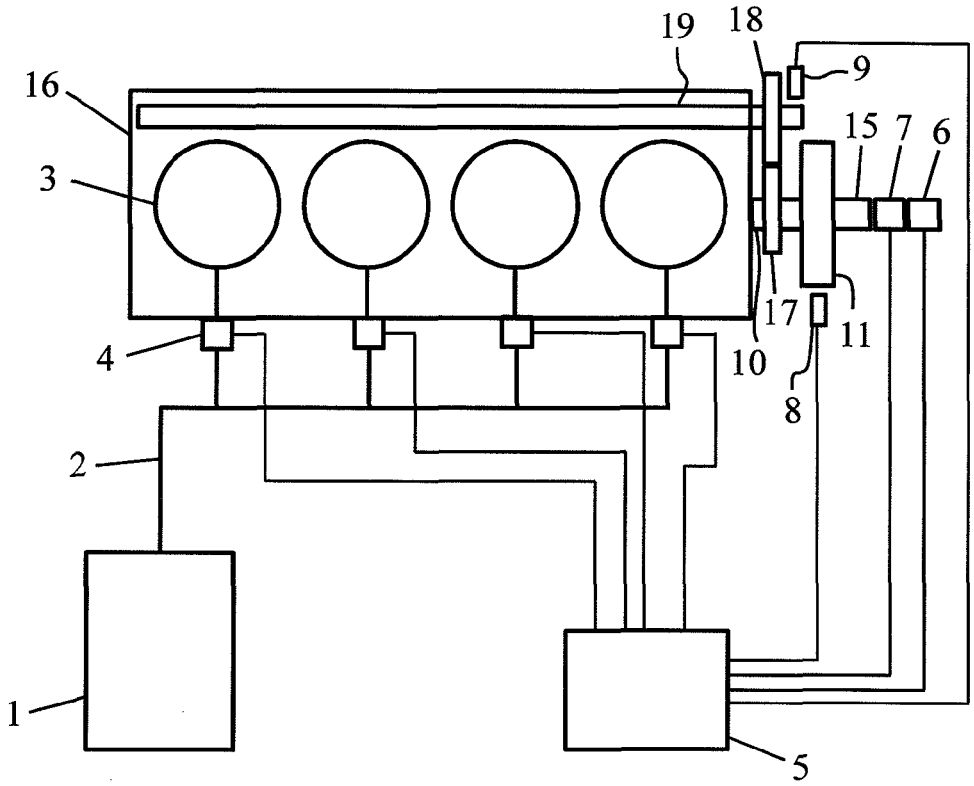
FIG. 1 shows schematically a starting system according to the present invention.

The invention is now described in more detail with reference to the accompanying drawings. FIG. 1 shows schematically a simplified illustration of a starting system according to the present invention. The starting system comprises an air receiver 1 for storing pressurized air that can be used for starting an engine 16. The system also comprises a pipe system 2 for introducing the starting air into the cylinders 3 of the engine 16. The engine 16 is a large internal combustion engine that could be used for instance in a power plant or as a main or auxiliary engine of a ship. In FIG. 1 is shown an embodiment with four cylinders 3, but the engine 16 can comprise any reasonable number of cylinders 3 arranged for instance in-line or in a V-configuration. A starting valve 4 is arranged in connection with each cylinder 3 for controlling the admission of starting air into the cylinder 3. The operation of the starting valves 4 is controlled by a control unit 5. The starting valves 4 can be actuated by any conventional means well-known in the art. For instance electrical, hydraulic or pneumatic actuators can be used. It is also possible to utilize control valves that control the starting valves 4. For instance solenoids can be used to actuate the control valves.

In the embodiment of FIG. 1, all the cylinders 3 of the engine 16 are equipped with a starting valve 4. However, it is possible that only some of the cylinders 3 are provided with starting valves 4.

The engine 16 is provided with a rotation speed sensor 8 that measures the rotation speed of the engine 16 from a flywheel 11. The flywheel 11 is arranged at the end of the crankshaft 10. Between the flywheel 11 and the engine 16, there is a gear 17 that rotates with the crankshaft 10. The gear 17 is engaged with a second gear 18 that is arranged to rotate a camshaft 19. A phase sensor 9 is arranged to determine the angular position of the engine 16 from the camshaft 19 when the engine 16 is running.

The starting system comprises an absolute rotary encoder 6 that can be used for determining the crank angle of the engine 16. The absolute rotary encoder 6 can be for instance an optical encoder or a resolver. The absolute rotary encoder 6 outputs a signal indicating its angular position.

Figure 2:
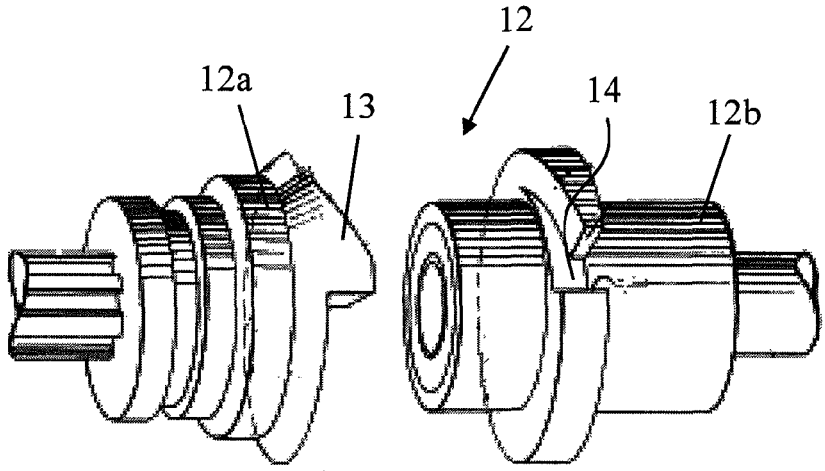
FIG. 2 shows an example of a clutch type that can be used as a part of the invention.

Coupling means 7 are arranged between the engine 16 and the absolute rotary encoder 6. The coupling means 7 comprise a clutch 12. One example of a suitable clutch type is shown in FIG. 2. The clutch 12 comprises a first clutch part 12*a* and a second clutch part 12*b*. The first clutch part 12*a* is provided with a protrusion 13 and the second clutch part 12*b* is provided with a groove 14. The first clutch part 12*a* is attached to an extension 15 of the crankshaft 10. The second clutch part 12*b* is attached to the absolute rotary encoder 6. When the first and second clutch parts 12*a*, 12*b* are brought into connection with each other, the groove 14 is engaged by the protrusion 13. The first and second clutch parts 12*a*, 12*b* are thus always in the same position in relation to each other when the clutch 12 is coupled. The connection between the first clutch part 12*a* and the second clutch part 12 is established by moving the second clutch part 12*b* together with the absolute rotary encoder 6 axially towards the first clutch part 12*a* so that the clutch parts 12*a*, 12*b* engage with each other. For instance a hydraulic or pneumatic actuator can be provided to couple the absolute rotary encoder 6 to the engine 16.

When the absolute rotary encoder 6 is connected to the extension 15 of the crankshaft 10 via the coupling means 7, the crank angle of the engine 16 can be determined even when the engine 16 is at rest. The absolute rotary encoder 6 could also be connected to another rotary part of the engine 16, if the angular position of that part is in relation to the crank angle. For instance, the absolute rotary encoder 6 could be coupled to the camshaft 19.

Figure 3:
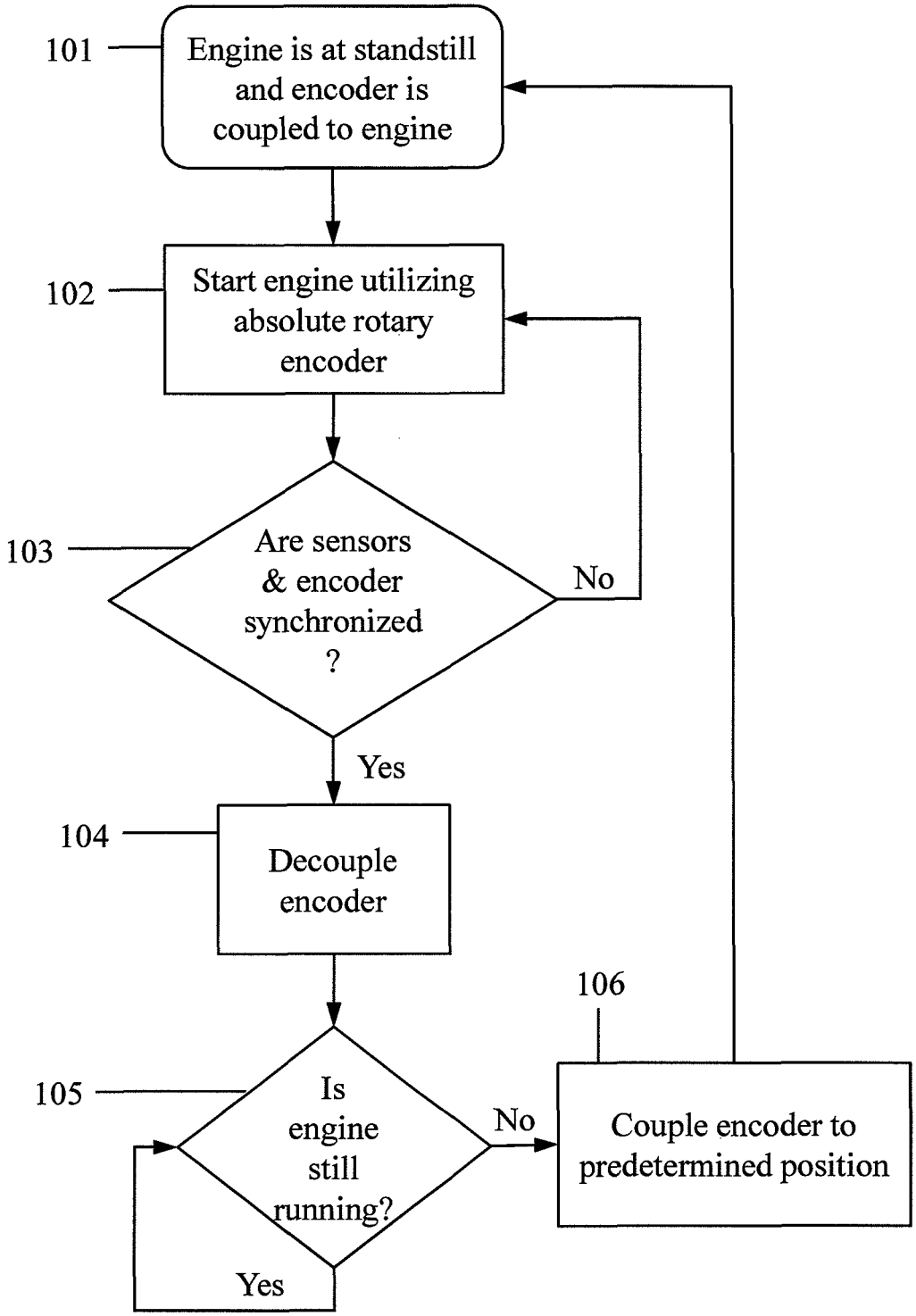
FIG. 3 shows as a flowchart the working principle of the present invention.

The operating principle of the method according to the present invention is shown as a flowchart in FIG. 3. At the initial state 101, the engine 16 is at a standstill and the absolute rotary encoder 6 is coupled to the engine 16. In the next stage 102, the engine 16 is started utilizing the absolute rotary encoder 6. The crank angle of the engine 16 is determined by using the encoder 6, and the most suitable cylinder 3 for initial starting air injection is chosen. An opening signal is sent from the control unit 5 to the respective starting air valve 4 and the valve 4 is opened. Starting air can thus flow from the air receiver 1 via the pipe system 2 into the cylinder 3 and move the piston. As the piston moves the crankshaft 10 rotates. The absolute rotary encoder 6 is used for monitoring the crank angle. Based on the detected crank angle, next cylinder 3 is chosen for starting air injection and the respective starting valve 4 is opened. The starting valves 4 can be controlled individually and there can be some overlap in the air injection into the cylinders 3 that are consecutive in the firing order. The absolute rotary encoder 6 can also measure the rotation speed of the engine 16 and this data can be used to determine the correct air injection duration.

Air injection is continued for reaching an adequate starting speed and fuel is injected into the cylinders 3 with appropriate timing so that the engine 16 eventually starts. At the following step 103, the sensor synchronization is checked. The rotation speed and crank angle of the engine 16 are monitored by using the rotation speed sensor 8 and phase sensor 9. The output of these sensors 8, 9 is compared to the output of the absolute rotary encoder 6. When it is detected that the rotation speed sensor 8 and the phase sensor 9 are synchronized with the absolute rotary encoder 6, a decoupling stage 104 follows, and the encoder 6 is decoupled from the engine 16. The system keeps following that the engine 16 is still running 105. When it is detected that the engine 16 is shut down, the absolute rotary encoder 6 is coupled again to the engine 16 into the predetermined position 106. The crank angle of the engine 16 can thus be determined immediately when the engine 16 is to be started next time.

The invention is not limited to the embodiments described above, but may vary within the scope of the appended claims. For instance, the absolute rotary encoder can be coupled to the free-end of the engine.

The invention claimed is:

1. A starting system for an internal combustion engine, which system comprises:

a pressure medium source;

means for connecting the pressure medium source to at least two of the cylinders of the engine;

a starting valve in connection with each cylinder that is connected to the pressure medium source for controlling the admission of the pressure medium into the cylinder;

a control unit for controlling the operation of the starting valves;

an absolute rotary encoder for determining the crank angle of the engine; and coupling means arranged between the engine and the absolute rotary encoder for releasably coupling the encoder to the engine, the coupling means enabling decoupling of the absolute rotary encoder from the engine when the engine is running.

2. The starting system according to claim 1, wherein the engine is provided with additional means for determining the rotation speed and crank angle of the engine.

3. The starting system according to claim 1, wherein the coupling means comprise a clutch having a first clutch part rotating with the crankshaft of the engine and a second clutch part being engageable into a predetermined position with the first clutch part.

4. The method for starting an internal combustion engine, which method comprises:

determining the crank angle of the engine by means of an absolute rotary encoder;

based on the crank angle, selecting a suitable cylinder for pressure medium injection;

introducing pressure medium into the selected cylinder for rotating the crankshaft of the engine;

repeating said determining the crank angle, said selecting and said introducing until the engine is running;

determining the crank angle and rotation speed of the engine by means of the absolute rotary encoder;

comparing the crank angle and rotation speed data of the absolute rotary encoder to the data of additional means for determining the rotation speed and crank angle of the engine; and repeating said determining the crank angle and the rotation speed and said comparing until the additional means for determining the rotation speed and crank angle of the engine are synchronized with the absolute rotary encoder, wherein the absolute rotary encoder is decoupled from the engine when the engine is running after a predetermined rotation speed is reached and the additional means for determining the rotation speed and crank angle of the engine are synchronized with the absolute rotary encoder.

5. The method according to claim 4, wherein said absolute rotary encoder is coupled when the rotation speed of the engine drops below a predetermined value.

6. The method according to claim 5, wherein the absolute rotary encoder is coupled when the engine is stopped.

7. An internal combustion engine, comprising the starting system according to claim 3.

8. A starting system for an internal combustion engine, which system comprises:

a pressure medium source;

a connector for connecting the pressure medium source to at least two of the cylinders of the engine;

a starting valve in connection with each cylinder that is connected to the pressure medium source for controlling the admission of the pressure medium into the cylinder;

a control unit for controlling the operation of the starting valves;

an absolute rotary encoder for determining the crank angle of the engine; and a clutch arranged between the engine and the absolute rotary encoder for releasably coupling the encoder to the engine, the clutch enabling decoupling of the absolute rotary encoder from the engine when the engine is running.

* * * * *